United States Patent [19]

Courtemanche et al.

[11] Patent Number: 4,723,740

[45] Date of Patent: Feb. 9, 1988

[54] SUPPORT HOOK FOR PLASTIC BAG

[76] Inventors: Richard Courtemanche, 5129 Kenside Ct., Annandale, Va. 22003; Timothy D. McCormack, 4026 Poplar St., Fairfax, Va. 22030

[21] Appl. No.: 945,800

[22] Filed: Dec. 24, 1986

[51] Int. Cl.[4] ..... B65B 67/12

[52] U.S. Cl. ..... 248/95; 248/227; 248/304

[58] Field of Search ..... 248/95, 97, 98, 99, 248/100, 101, 304, 305, 215, 227, 301, 303

[56] References Cited

U.S. PATENT DOCUMENTS

| | | | |
|---|---|---|---|
| 1,808,521 | 6/1931 | Broder | 248/215 X |
| 4,504,992 | 3/1985 | Herron et al. | 248/215 X |
| 4,606,521 | 8/1986 | Williams | 248/301 X |

*Primary Examiner*—Ramon O. Ramirez

*Attorney, Agent, or Firm*—Richard C. Litman

[57] ABSTRACT

A support hook for supporting a plastic bag inside a waste container comprises two side walls disposed in side by side relation and joined by an intermediate wall which extends therebetween. Three arms project laterally from one side wall and a hook projects laterally from the other side wall.

3 Claims, 4 Drawing Figures

FIG. 1
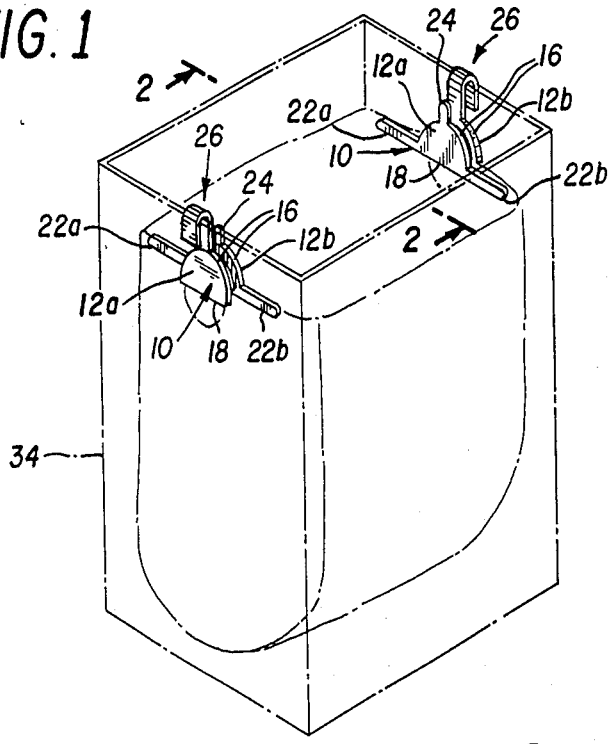
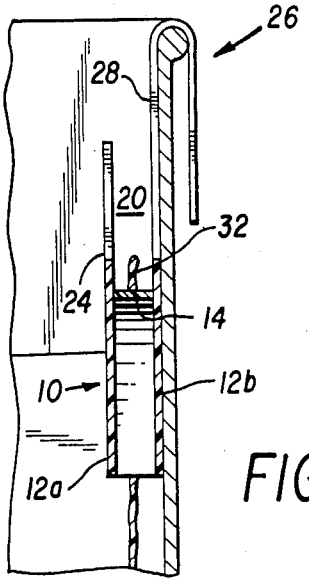
FIG. 3
FIG. 2
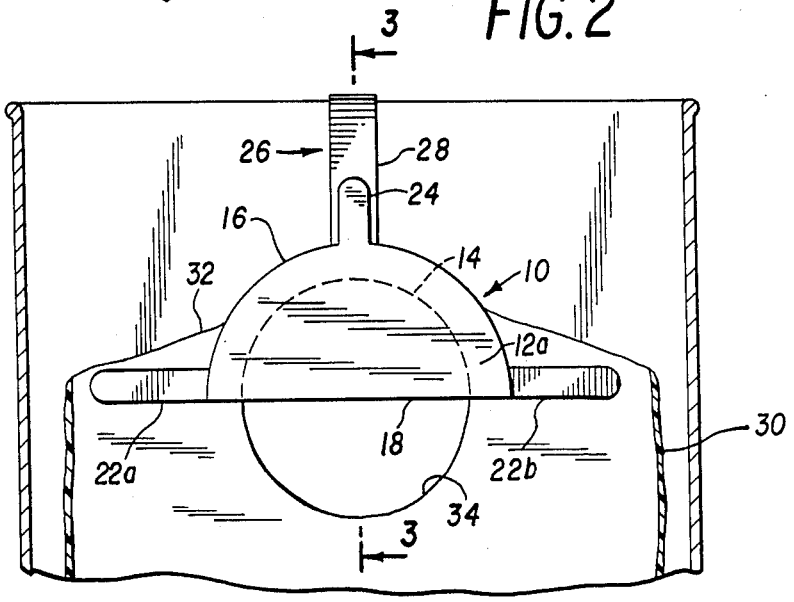
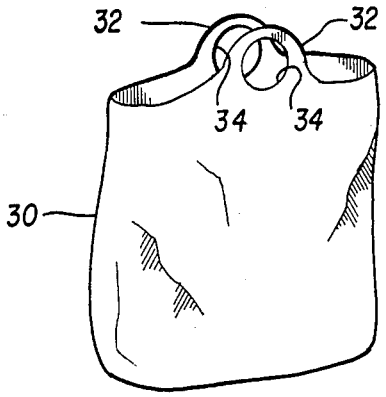
FIG. 4

SUPPORT HOOK FOR PLASTIC BAG

FIELD OF THE INVENTION

The invention disclosed herein relates to a support hook and more particularly to a support hook for holding a plastic bag inside a waste container.

BACKGROUND OF THE INVENTION

Recently stores have begun to supply customers with plastic carrying bags having handle-forming cutouts adjacent the open ends thereof, such bags being stronger and more easily carried than paper bags. Such plastic bags are usually thrown away after purchased items are removed therefrom, but the invention disclosed herein enables them to be used conveniently as liners for waste containers.

BRIEF SUMMARY OF THE PREFERRED EMBODIMENT OF THE INVENTION

A preferred embodiment of the invention is integrally formed of a polymeric material such as polystyrene or the like and comprises a body portion having (1) two flat side walls disposed in spaced, parallel relation to each other and each having a semicircular top edge and a straight bottom edge, and (2) a curved wall extending between and connected to said side walls and uniformly spaced from the top edges thereof to provide a curved channel for retaining a handle portion of a plastic bag of the type referred to hereinbefore. Three elongate arms are joined to one of the side walls of the device and project laterally therefrom, two of these arms being disposed in opposed relation to each other on opposite sides of the side wall and next to its bottom edge and the third arm being centered between the opposed arms and in perpendicular relation therewith. Lastly, the shank of a hook is joined to the other side wall of the device and projects laterally therefrom in parallel relation with said third arm.

DESCRIPTION OF THE DRAWINGS

FIG. 1 is a pictorial view illustrating a pair of support hooks each arranged in the preferred form of the invention, the drawing showing the pair of support hooks as they appear when used to hold a plastic bag inside a waste receptacle.

FIG. 2 is a cross-sectional view of the waste receptacle shown in FIG. 1, taken along the plane represented by the line designated 2—2 in FIG. 1 and illustrating one of the support hooks of the invention in side view.

FIG. 3 is a cross-sectional view of the support hook shown in FIG. 2, taken along the plane represented by the line designated 3—3 in the latter drawing.

FIG. 4 is a pictorial view of the plastic bag shown in FIG. 1.

DETAILED DESCRIPTION OF THE PREFERRED EMBODIMENT OF THE INVENTION

In FIG. 1 reference number 10 generally designates a body portion of a support hook constituting a preferred form of the invention, the body portion of the support hook comprising (1) two flat sides walls 12*a*, 12*b* which are identical in shape and which are disposed in spaced, parallel relation to each other, and (2) a curved wall 14 which is illustrated in cross section in FIG. 3 and by broken lines in FIG. 2 and which extends between and is integrally joined to the side walls. More specifically, each side wall 12*a*, 12*b* has a semicircular top edge 16 and a straight bottom edge 18, and the intermediate wall 14 is uniformly spaced below the top edges of the side walls to provide a curved retaining channel 20 (see FIG. 3) in the body portion 10 of the support hook.

Two elongate, flat arms 22*a*, 22*b* are integrally joined to side wall 12*a* and project laterally thereform in opposed relation to each other next to the bottom edge 18 of the side wall. A third elongate, flat arm 24 is also integrally joined to side wall 12*a* and projects laterally therefrom, this third arm being centered between the opposed arms 12*a*, 12*b* and in perpendicular relation therewith as illustrated.

In the drawings reference number 26 generally designates a hook formed of an elongate strip and having a shank 28 which is integrally joined to side wall 12*b* and which projects laterally thereform and is disposed in side by side parallel relation with arm 24. Thus the shank 28 of hook 26 is also centered between opposed arms 22*a*, 22*b* and is perpendicular thereto like arm 24.

USE OF THE PREFERRED EMBODIMENT OF THE INVENTION

FIG. 4 illustrates a plastic carrying bag 30 having handles 32 formed at its open end by circular cutouts 34. Body portion 10 of the disclosed support hook is sized so that its side wall 12*b* will pass through cutout 34 with a small clearance. In FIG. 1 bag 30 is illustrated as it appears when held within a waste receptacle 34 by a pair of support hooks having the above-described construction. When bag 30 is to be installed within receptacle 34 to serve as a liner, the hook 26 and side wall 12*b* of each support hook are inserted through a respective one of the holes 34 in the bag so that the shank 28 of the hook is positioned outside the bag and extends upward from its upper edge. Handle portions 32 of the bag are then respectively positioned within the curved channels 20 between side walls 12*a*, 12*b* of the two support hooks. Bag 30 is then lowered into receptacle 34 and hooks 26 are respectively engaged with opposite upper edges of the receptacle. Arms 24 of the support hooks assist in retaining the handle portions 32 of bag 30 within channels 20 of the support hooks, and opposed arms 22*a*, 22*b* of the support hooks hold bag 30 adjacent the wall of the receptacle 34. Thus bag 30 is securely held within receptacle 30 by a pair of the disclosed support hooks.

It will be recognized that various changes can be made in the device which has been illustrated and described, without departing from the concept of the invention. For example, opposed arms 22*a*, 22*b* can be curved so that they conform with the wall of a cylindrical waste receptacle. Hence the scope of the invention must be considered to be limited only by the terms of claims appended hereto.

We claim:

1. A support hook comprising:

a body portion having (1) two flat side walls disposed in spaced, substantially parallel relation to each other and each having a curved top edge and a substantially straight bottom edge, and (2) a curved wall extending between and joined to said side walls and spaced from the top edges thereof to provide a curved retaining channel in said body portion;

a pair of elongate arms joined to one of said side walls and projecting laterally therefom in opposed relation to each other next to the bottom edge thereof; and a hook, the shank of which is joined to the other of said side walls and which projects laterally therefrom and is centered between said opposed arms in substantially perpendicular relation therewith.

2. The support hook defined in claim 1 including a third elongate arm joined to and projecting laterally from the same side wall to which said opposed arms are connected, said third arm being centered between said opposed arms and in substantially perpendicular relation therewith.

3. The support hook defined in claim 1 wherein the top edges of said side walls are substantially semicircular.

* * * * *